US007498588B1

(12) United States Patent
Gordon et al.

(10) Patent No.: US 7,498,588 B1
(45) Date of Patent: Mar. 3, 2009

(54) TANDEM ACCELERATOR HAVING LOW-ENERGY STATIC VOLTAGE INJECTION AND METHOD OF OPERATION THEREOF

(75) Inventors: Michael S. Gordon, Yorktown Heights, NY (US); Carl Emil Bohnenkamp, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/116,935

(22) Filed: May 7, 2008

(51) Int. Cl.
*H05H 11/00* (2006.01)

(52) U.S. Cl. ..... 250/424; 250/492.1; 250/492.3; 250/492.21; 250/423 R; 376/108; 376/111; 376/114; 315/500; 315/506; 315/111.81; 313/359.1

(58) Field of Classification Search ..... 250/492.1, 250/492.3, 492.21, 423 R, 424, 423 F, 299, 250/306; 376/100, 108, 111, 114, 116, 117, 376/120, 128, 156, 157, 190; 315/500, 506, 315/111.81; 313/359.1
See application file for complete search history.

(56) References Cited

U.S. PATENT DOCUMENTS

| | | | | |
|---|---|---|---|---|
| 3,353,107 | A | 11/1967 | van de Graff | |
| 4,209,704 | A | 6/1980 | Krimmel | |
| 4,447,773 | A | 5/1984 | Aston | |
| 4,812,775 | A * | 3/1989 | Klinkowstein et al. | 315/506 |
| 4,980,556 | A | 12/1990 | O'Connor et al. | |
| 5,247,263 | A * | 9/1993 | Purser | 315/507 |
| 5,293,134 | A | 3/1994 | Holmes et al. | |
| RE34,575 | E | 4/1994 | Klinkowstein et al. | |
| 5,300,891 | A * | 4/1994 | Tokoro | 315/500 |
| 5,306,922 | A | 4/1994 | O'Connor | |
| 5,363,053 | A | 11/1994 | Etievant et al. | |

(Continued)

FOREIGN PATENT DOCUMENTS

EP 0300105 A2 1/1989

(Continued)

OTHER PUBLICATIONS

Cho, Y.S.;Song, W.S.;Choi, B.H. "Development of 1 MV tandem proton accelerator" Particle Accelerator Conf., Chicago, IL, USA, 2001. PAC 2001. Prcd of 2001, vol. 4, pp. 2503-2505.

(Continued)

*Primary Examiner*—Jack I Berman
*Assistant Examiner*—Michael J Logie
(74) *Attorney, Agent, or Firm*—Thorne & Halajian, LLP

(57) ABSTRACT

A method of producing an ion beam in a tandem accelerator, the method includes the acts of insulating, in a cavity containing an insulating gas under pressure, a beam tube having first and second ends and a terminal situated between the first and second ends; seating, using a load lock valve, the insulating gas under pressure; generating an operating voltage using a first voltage source situated outside the cavity when the operating voltage is less than or equal to a threshold value; generating the operating voltage using a second voltage source situated inside the cavity when the operating voltage is greater than the threshold value; coupling the terminal to the first or second voltage sources; generating, using a particle source, an ion beam; and accelerating the ion beam in a first and second parts of the beam tube.

1 Claim, 3 Drawing Sheets

U.S. PATENT DOCUMENTS

| | | | | |
|---|---|---|---|---|
| 5,468,355 | A * | 11/1995 | Shefer et al. | 204/157.2 |
| 5,534,699 | A * | 7/1996 | Ferry | 250/396 R |
| 5,644,130 | A * | 7/1997 | Raatz | 250/288 |
| 5,808,308 | A | 9/1998 | Holkeboer | |
| 5,907,158 | A | 5/1999 | Nasser-Ghodsi et al. | |
| 6,414,327 | B1 * | 7/2002 | Klinkowstein et al. | 250/492.21 |
| 6,423,976 | B1 * | 7/2002 | Glavish et al. | 250/492.21 |
| 6,815,666 | B2 | 11/2004 | Schroeder et al. | |
| 7,019,316 | B2 | 3/2006 | Cho | |
| 2006/0011866 | A1 * | 1/2006 | Cho | 250/492.21 |

FOREIGN PATENT DOCUMENTS

| | | |
|---|---|---|
| JP | 02051900 | 2/1990 |
| JP | 05326190 | 12/1993 |
| JP | 07169597 | 7/1995 |
| JP | 10335099 | 12/1998 |
| WO | WO 98/33199 | 7/1998 |

OTHER PUBLICATIONS

Ziegler, Norval F. "Control System for the Holifield Heavy Ion Research Facility Beam Buncher" Nuclear Science, IEEE Transactions, Jun. 1979, vol. 26, Issue: 3, pp. 3304-3306.

* cited by examiner

TANDEM ACCELERATOR HAVING LOW-ENERGY STATIC VOLTAGE INJECTION AND METHOD OF OPERATION THEREOF

FIELD OF THE INVENTION

The present invention relates generally to ion accelerators and, more particularly, to tandem accelerators having a low-energy static voltage injector and an extended lower voltage limit, and a method of operation thereof.

BACKGROUND OF THE INVENTION

Tandem accelerators typically use a charging system and are used to produce beams of charged particles having a very high energy such as, for example, 10 MeV. These beams can then be used for various applications, such as, for example, basic nuclear physics studies, cancer therapy, radioisotope production, and materials analysis. Unfortunately, conventional tandem generators cannot be properly controlled by their voltage feedback systems when the terminal voltage (i.e., the voltage at a terminal or terminal cell inside the tandem accelerator) falls below a certain voltage level such as 5-10% of the maximum operating voltage. For example, the voltage cannot be regulated below approximately 0.3 MV for 3 MV conventional tandem generator, and for a 25 MV generator, voltage regulation is lost around approximately 1-2 MV.

Typically, a Tandem Van de Graff-type accelerator, or more simply, a Tandem has a column having a low-energy or first beam tube (or column) and a high-energy or second beam tube (or column), a stripper cell, beam steering means, a terminal cell (e.g., including an electrode) which is disposed between the high- and low-energy beam tubes, and a charging system, all of which are contained within a pressure vessel which provides proper pressure (e.g., either pressure or vacuum) for proper electrical isolation. The charging system typically comprises a moving belt or a chain comprising an insulating material which is used to convey a charge to the terminal via, for example, a "pickoff pulley," as disclosed in, for example, U.S. Pat. No. 3,353,107, entitled "High Voltage Particle Accelerators Using Charge Transfer Processes," to Van de Graaff (the '107 patent) which is incorporated herein by reference in its entirety. Van de Graaff discloses a power source comprising a single insulating belt which is located within a pressure vessel. As mentioned above, this system is difficult to regulate below a certain voltage value and is therefore not suitable for certain uses.

In Tandems, as well as other electrostatic accelerators, a generating Voltmeter (GVM) is typically used to measure the voltage on the terminal. The GVM comprises a rotating and stationary vane assembly in close proximity with each other, with the rotating vane assembly facing the terminal. The GVM generates a signal that is proportional to the voltage on the terminal. The terminal voltage is controlled by either the feedback from a corona discharge between the terminal and sharp needles, known as corona points, or feedback from the accelerated beam itself as it is deflected and its beam current recorded by slits. This feedback is then used to control the terminal voltage.

Although there have been attempts to use other power sources in tandem accelerators, such as disclosed in U.S. Pat. Nos. Re 34,575 (the '575 patent) and 6,414,327, entitled "Electrostatic Ion Accelerator" and "Method and Apparatus for Ion Beam Generation," respectively, both to Klinkowstein, which are incorporated herein by reference in their entirety. Similarly to the '107 patent, these two patents disclose power supplies located within a pressure vessel used to house the beam tubes. Further, the solid state rectifier-type power supply disclosed by the '575 patent is subject to "sag" which is attributable to AC impedance of capacitors in earlier stages and a voltage ripple effect which is amplified by the number of stages used. Accordingly, it is difficult to control the voltage at the terminal of the '575 patent.

Another type of tandem accelerator is disclosed in U.S. Pat. No. 5,293,134, entitled "Tandem Accelerator," to Holmes, which is incorporated herein by reference in its entirety, and which discloses using vacuum rather than an insulating gas within a pressure vessel. Further, Holmes discloses integrating accelerating and electric stress shields which are used as capacitors and are different from the beam tube which is taught by the present invention.

Further, it is difficult to maintain a corona discharge current, which is necessary to control the terminal voltage, in the absence of a beam, at terminal voltages which are lower than a threshold value in conventional tandems.

Accordingly, there is a need for an apparatus capable of providing stable low-voltage operation for a tandem accelerator which can be accurately and easily controlled when the terminal voltage is below the aforementioned threshold level.

Further, there is a need for a tandem accelerator which can provide a moderately low-energy beam having an energy which is suitable for high-resolution analytical techniques such as, for example, Nuclear Reaction Analysis (NRA).

SUMMARY OF THE INVENTION

Therefore, it is an object of the present invention to solve the above-noted and other problems of conventional tandem accelerators and to provide an apparatus and a method for providing a low-energy output beam which is suitable for providing enhanced analytical resolution in various techniques such as, for example, NRA.

In one embodiment, an ion accelerator apparatus includes a negative ion-source for producing a negatively-charged ion beam, a beam tube having opposing first and second ends, a vacuum chamber extending between the first and second ends, and adapted to receive the ion beam at one of the first or second ends. A high-voltage terminal cell (hereinafter terminal or terminal cell) at positive voltage is situated between the first and second ends of the beam tube and receiving a high voltage. A pressure vessel defining at least part of a cavity contains the terminal and an insulating gas under pressure. While within the beam tube, the ion beam travels in the vacuum of the vacuum chamber. A high voltage power source is coupled to the terminal and is situated outside of the cavity.

The ion accelerator apparatus further includes a stripping canal located adjacent to or in the terminal and changes the charge of the ion beam by stripping off electrons such that the ion beam is further accelerated in the second part of the beam tube.

The high voltage power supply generates a high voltage (e.g., positive) with respect to ground potential. The apparatus may further include a load-lock valve for scaling the insulating gas under pressure and which is situated between an external high-voltage power supply and the terminal. A drift detector may be configured to determine drift of the accelerated and deflected ion beam, and a controller may be configured to adjust the voltage of the high-voltage terminal based upon the determined drift of the ion beam from a reference value, which may be predetermined. Of course, if desired, one embodiment may include a feedback loop for feeding back a signal (e.g. an error signal which is a result of a comparison of a measured signal with a reference value) from one or more locations either within or outside of the beam tube, to the high-voltage power supply.

Further, in a method for producing an ion beam in a tandem accelerator having a cavity, the method including the acts of controlling an atmosphere in the cavity filled at least in part with an insulating gas; producing, using an ion generator, an ion beam; receiving the ion beam by a beam tube having first and second parts and which is located at least in part within the cavity; transmitting a predetermined high voltage from a high-voltage generator located outside of the cavity; receiving the ion beam by the beam tube and accelerating the ion beam in the first part of the beam tube; receiving the ion beam by a terminal cell which is situated between the first and second parts of the beam tube and changing a charge state of the ion beam; and accelerating the ion beam in the second part of the beam tube.

The method may further include the acts of stripping the ion beam in a stripping canal so as to change the charge of the ion beam after the ion beam has been accelerated in the first part of the beam tube such that the ion beam can be accelerated by the second part of the beam tube; subjecting the ion beam to a magnetic defection field; determining, using a drift detector, drift of the ion beam; and providing the determined drift information to a controller (which, for example, can include a phase locked loop (PLL)).

The method may further include the act of adjusting, by the controller, the voltage of the terminal cell using the determined drift information. The method may further include the acts of situating a load-lock valve between the high-voltage generator and the terminal; passing an output voltage from the high-voltage generator to the terminal via the load-lock valve; sealing the insulating gas in the cavity using the load-lock valve; and maintaining a predetermined pressure within the cavity using a pressure maintaining device, such as, for example, a pump, a pressurized gas, and the like.

According to another aspect of the present invention, a method of producing an ion beam in a tandem accelerator is disclosed, the method includes the acts of insulating, in a cavity containing an insulating gas under pressure, a beam tube having first and second ends, a vacuum chamber, and a terminal situated between the first and second ends; sealing, using a load lock valve, the insulating gas under pressure; generating an operating voltage using a first voltage source situated outside the cavity when the operating voltage is less than or equal to a threshold value; generating the operating voltage using a second voltage source situated inside the cavity when the operating voltage is greater than the threshold value; coupling the terminal to the first or second voltage sources; generating, using a particle source, an ion beam; receiving the ion beam at the first end of the beam tube; accelerating the ion beam in a first part of the beam tube that is situated between the first end of the beam tube and the terminal; changing the charge state of the ion beam; and accelerating the ion beam in a second part of the beam tube which is situated between the terminal and the second end of the beam tube.

According to the method, the coupling step may include the acts of inserting a voltage injector through the load lock valve when the operating voltage is less than or equal to the threshold value; and withdrawing the voltage injector from the load lock valve when the operating voltage is greater than the threshold value without the need to remove the insulating gas while inserting or withdrawing the voltage injector. Further, the method may include the acts of determining drift of the ion beam after the ion beam has been accelerated, by the terminal, in the first and second parts of the beam tube and deflected through a fixed and stable magnetic field; selecting a desired voltage based upon the determined drift as compared to a reference value; and setting an output voltage setting of the first voltage source in accordance with the selected desired voltage.

The ion accelerator may further include a beam tube having a plurality of beam tube parts and a high-voltage terminal situated between the beam tube parts, the beam tube is situated within a cavity having a desired pressure, and a high-voltage power supply is coupled to the high-voltage terminal and situated outside of the cavity, the beam tube includes a vacuum chamber in which the ion beam travels when it is in the beam tube, and a controller which can determine the drift, with respect to a reference value, of the ion beam after it is deflected by a magnetic field, and adjust a voltage setting of the high-voltage power supply based upon the determination. The beam tube includes a voltage divider network which provides a uniform gradient along the beam tube with both ends of the beam tube, farthest away from the terminal, being at ground potential.

The beam tube may include a voltage grading resistor chain, insulating rings, metal electrodes, protective spark gaps, as is known in the art, for maintaining a proper voltage gradient.

The voltage provided by the high-voltage source may be precisely controlled before it is provided to the terminal even at low voltage values such as below 5% of the nominal operating voltage, thus obviating the need for a conventional feedback system which measures the voltage at the terminal.

BRIEF DESCRIPTION OF THE DRAWINGS

Embodiments of the present invention will now be described, by way of example, with reference to the accompanying drawings, wherein.

DETAILED DESCRIPTION OF THE INVENTION

Figure 1:
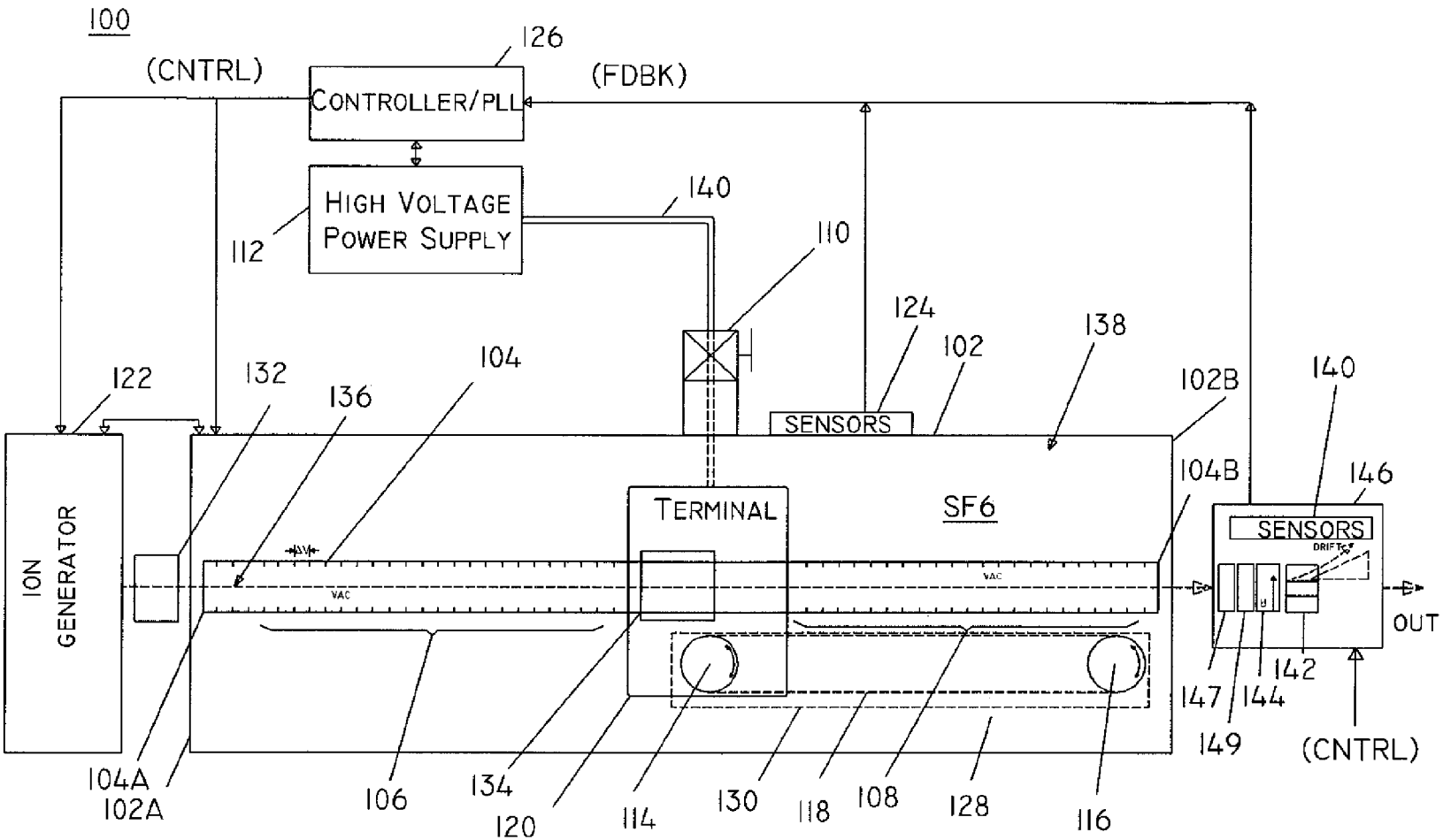
FIG. 1 is a block diagram illustrating a tandem generator according to the present invention.

In the drawings the same reference numerals have been used to indicate corresponding features.

Preferred embodiments of the present invention will now be described in detail with reference to the drawings. For the sake of clarity, certain features of the invention will not be discussed when they would be apparent to those with skill in the art.

The present invention includes a solid state power supply (e.g., a power supply using solid state components such as, for example coils, capacitors, diodes, etc.) to generate an electrical charge in addition to another power source which can include an electrostatic induction source such as a Van de Graaff-type power supply which uses an electromechanical means such as, for example, a belt or a chain (e.g., a Pelletron chain) to generate an electrical charge. The solid state power supply may include for example, Glassman High Voltage, Inc, model LT100P20 (0-100 kV, 0-25 mA) positive high voltage supply.

A block diagram of a tandem generator according to the present invention is shown in FIG. 1. A tandem generator 100 includes an accelerator tank 102, a beam tube 104, a high-voltage terminal cell 120, a load-lock valve 110, a high voltage power supply 112, a charging system 130, a stripping cell 134, and an optional controller 126. A beam steering and/or focusing device 132 conditions the ion beam 136 prior to entering the beam tube 104.

The accelerator tank 102 has first and second opposing ends 102A and 102B, respectively, and forms at least part of a cavity 128 which can maintain a desired atmosphere for proper electrical and/or thermal insulation. Accordingly, an insulating gas 138 such as, for example, sulfur hexafluoride ($SF_6$) can be maintained at a desired temperature and/or pressure within the cavity by the accelerator tank 102. A conventional ion generator 122 provides a beam of negative ions, as desired. The beam conditioning 132 can include, for example, a 90 degree magnet so that ions of the proper charge/mass ratio are injected into the beam tube, as well as beam alignment devices. In the present embodiment, it will be assumed that negatively-charged ions are provided by the ion generator 122. The ion generator 122 can be optionally controlled by the controller 126.

The beam tube 104 is fully (as shown) or at least partially contained within the cavity 128 and has first and second ends 104A and 104B, respectively. The beam tube 104 can include a plurality of tubes, and in the present example, includes a first beam tube 106 and a second beam tube 108.

One or more optional beam steering and/or focusing devices 132 are positioned at various locations, as desired, and steer, focus, and/or otherwise condition the ion beam 136 between the ion generator 122 and the entrance 104A or downstream of the accelerated beam. Suitable beam-focusing devices include electrostatic lenses such as, for example, Einzel lenses or magnetic lenses such as quadrupoles.

The terminal cell 120 is located between the first and second ends 104A, 104B of the beam tube 104 and, in the present example, is situated between the first beam tube 106 and the second beam tube 108 which accelerate the ion beam received from the ion generator 122. For example, the terminal cell 120 is located at the center of the beam tube 104. The terminal cell 120 may include the stripping cell 134 which can change a charge of the ion beam by, for example, using a stripper foil, or a gas (e.g., $N_2$), which is suitable for the type of ion produced by the ion generator 122 and which can remove electrons from the ion beam 136 (e.g., $H^-$ generated by the ion generator 122) so as to produce a positively charged ion beam. For example, if the ion beam 136 generated by the ion generator 122 is a negative ion beam, the stripper cell can convert it into a positive ion beam after the ion beam passes therethrough. In other words, the stripper cell changes the charge of the ion beam. For ions heavier than H, there is a distribution of charge states that occurs after the beam passes through the stripping cell 134.

The charging system 130 is mounted in the interior of the cavity 128 and may include a chain-type charging system such as a Pelletron™-type charging system (manufactured by the National Electrostatics Corp., Middletown, Wis.). The charging system 130 provides a charge to the terminal cell 120 and includes a drive pulley 116, a pickoff pulley 114, and a mechanical force-transmitting device such as, for example, a chain 118 having metal pellets and nylon links. Although the Pelletron-type charging system is shown 130 for the user's convenience, in the preferred embodiment, it can be present and not operating. Accordingly, existing tandem accelerators using charge-tensioning devices such as the Pelletron-type charging system can be modified to benefit from the features and advantages of the present invention. As the Pelletron-type charging system is well known in the art, for the sake of clarity, a further description thereof will be omitted.

The high-voltage power supply 112 is located outside of the cavity 128 and generates a desired direct current (DC) voltage. In one embodiment, the high-voltage power supply 112 may be configured to provide voltage in the range of, for example, from 100 kV to 200 kV. The high-voltage power supply 112 is coupled to the terminal via the load-lock valve 110 such that the high-voltage potential produced by the high-voltage power supply 112 is supplied directly to the terminal cell 120. The terminal end of the high voltage cable has a spring device so that positive contact can be made with the terminal over a wide range of operating temperatures and vibration conditions.

The load-lock valve is attached to the accelerator tank 102 and is radially disposed from the terminal cell 120. The load-lock valve 110 passes one or more high-voltage leads 140 (e.g., voltage injectors) which couple the high-voltage power supply 112 to the terminal cell 120, and provides a suitable air-tight seal such that the insulating gas (e.g., $SF_6$) contained within the cavity 128 is maintained at a desired pressure. Suitable load-lock valves include the capability of withstanding a pressure differential of 100 PSI, an o-ring static seal and a captivating device to prevent accidental withdrawal.

A pressure control system may be provided to maintain a proper pressure and temperature within the accelerator tank 102 and can include pressure sensors, pumps, high-pressure tanks, heat exchangers etc. As shown in FIG. 1, an optional controller 126 can control the overall operation of the tandem accelerator and may be incorporated into, for example the high-voltage power supply 112, if desired.

An optional feedback system can include optional sensors 124 which are located at various positions either inside of or outside of the cavity 128 and which relay various operating parameters to, for example, the optional controller 126, the high-voltage power supply 112, and/or a user. For example, the sensors 124 can include voltage, current, temperature, pressure, etc., sensors, as desired, and provide corresponding information to the controller 126, the high-voltage power supply 112, and/or the user, as desired.

In the present embodiment, an optional conditioning cell 146 is located downstream of the second beam tube 108 and receives the ion beam 136 which was accelerated by the terminal voltage. The conditioning cell 146 can include a Faraday cup 147, beam profile monitor 149, other sensors 140 such as, for example, a deflection magnet 144 and position slits 142 located downstream of the deflection magnet 144, etc. The Faraday cup 147 determines the beam current of the ion beam 136 and relays corresponding information to the controller 126. The beam profile monitor 149 evaluates the position and focus of the ion beam 136 and relays corresponding information to the controller 126. After passing through the retracted Faraday cup 147 and the beam profile monitor 149, the ion beam 136 passes through the deflection magnet 144 which delivers the ion beam 136 to any of a number of beam lines. The position slits 142 are located on one or more of the beam lines. The magnetic field of the deflection magnet 144 is selected to deflect the beam of a given energy into a desired beam line.

For example, for ions heavier than H, there are multiple charge states that are generated in the stripper cell 134 and these ions are then further accelerated. Only ions having a certain charge state and energy are properly deflected in the deflection magnet 144 and can pass through a corresponding pair of slits of the position slits 142. This deflection is then measured by the sensors 140 which transmit information based upon the deflection to the controller 126, the high-voltage power supply 112, and/or a user. The controller 126 may then determine proper voltage and may control the high-voltage power supply 112 or the charging system 130, depending upon which is being used, accordingly. Although not shown, a nuclear reaction can be used to initially calibrate the voltage on the terminal cell 120, and the deflection magnetic 144 can then be adjusted to deliver this beam to a detection system (not shown). Any change in the beam energy will deflect the beam over the position slits 142 located on the beam line. Accordingly, the deflection of the ion beam 136 can be used to adjust the voltage of the terminal cell 120 by adjusting the voltage of, for example, the high-voltage power supply 112.

It is also envisioned that the magnetic field 144 can be optionally controlled by the controller 126 and that the controller 126 can optionally determine the initial energy of the ion beam 136 before it enters the beam tube 104.

An advantage of the present invention is that regulated voltages provided to the central terminal 120 can go below the typical feedback limit that is required for conventional feedback systems to work in tandem accelerators such as, for example, the 3 MV Tandem Van de Graaff accelerator (manufactured by the National Electrostatics Corp.). Accordingly, the tandem accelerator according to the present invention can be used to provide enhanced analytical resolution in techniques such as, for example, Nuclear Reaction Analysis (NRA), which can require beam energies <500 keV (or terminal voltages <250 kV).

Figure 2:
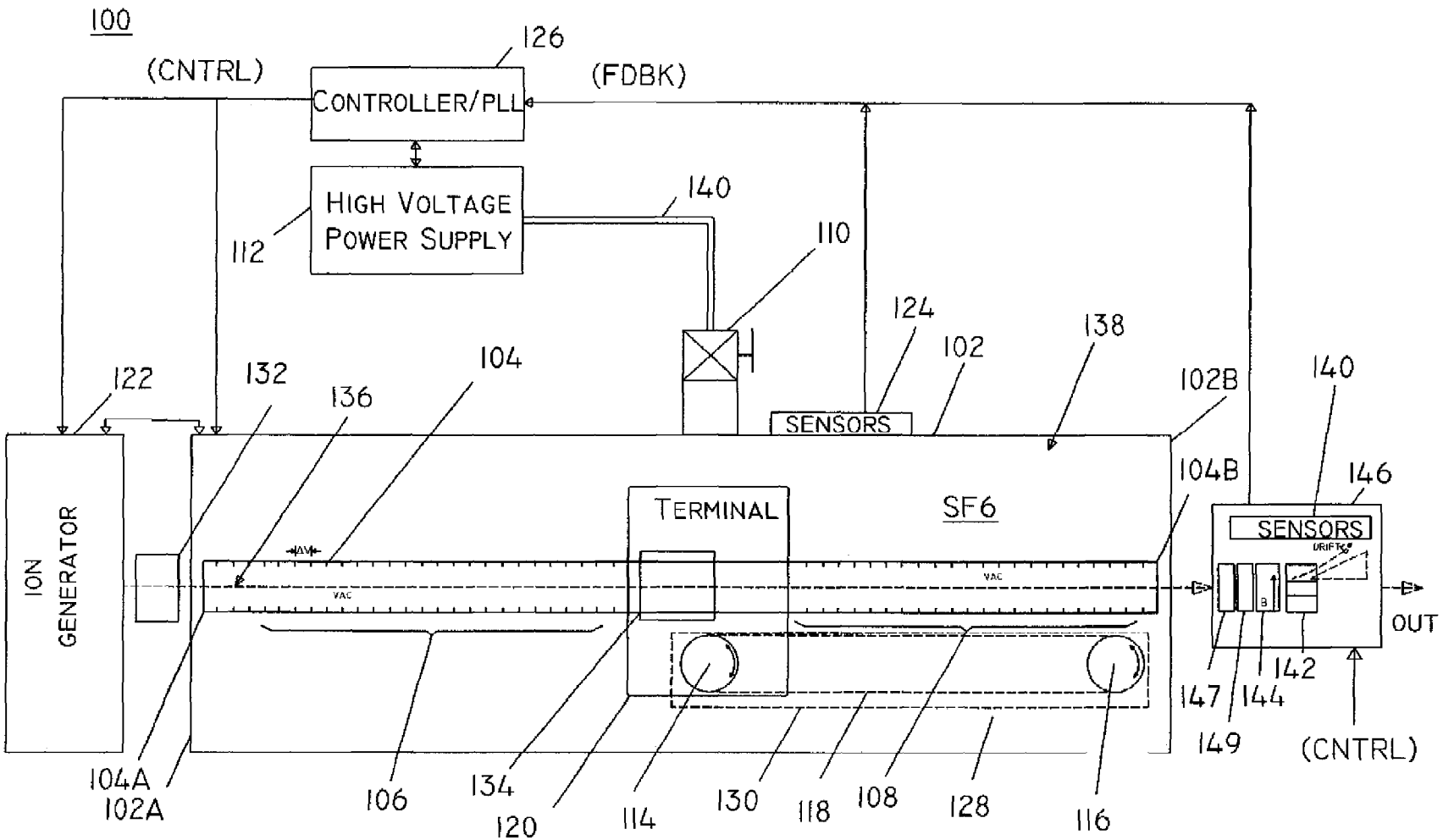
FIG. 2 is a block diagram illustrating the tandem generator of FIG. 1 with the voltage injector withdrawn.

FIG. 2 is a block diagram illustrating the tandem generator of FIG. 1 with the voltage injector withdrawn. When operating the tandem generator 100 using a terminal voltage that is above a threshold value of about 0.3 MV, the one or more high voltage leads 140 are withdrawn from the cavity 128 via the load-lock valve 110. Accordingly, the high-voltage power supply 112 is no longer coupled to the terminal cell 120. This prevents arcing when the charging system 130 produces voltages which are greater than the threshold value. When operating at terminal voltages which less than or equal to the threshold value, then the one or more high voltage leads 140 are inserted at least in part within from the cavity 128 so that the high-voltage power supply 112 is coupled to the terminal cell 120 (as shown in FIG. 1).

A brief summary of the operation of the tandem accelerator according to the present invention when using the high-voltage power supply 112 will now be given. In operation, the ion generator 122 outputs an ion beam 136 which is coupled to the beam tube 104 adjacent to an end of the first beam tube 106. The beam can be conditioned using optional conditioning means such as, for example, a beam focusing and/or steering device 132, a pre-analyzing magnet, etc. The ion beam 136 is then accelerated in the first beam tube 106 and thereafter enters the terminal cell 120, which is charged by the high-voltage power supply 112 to a desired voltage. An advantage of the present invention is that the voltage can be precisely set and regulated even at reduced voltages, using, for example, a voltage regulator within the high-voltage power supply 112 itself before it is output to the terminal 120. Thus, a conventional feedback system which measures voltage at the terminal 120 and the corona discharge as described earlier, and then attempts to properly adjust voltage using, for example, the corona points, is not required by the present invention. Further, the present tandem generator may be operated at reduced voltages by virtue of having the external voltage source or power supply 112 charge the central terminal 120 to a desired voltage, which may be less than 5% of the nominal operating voltage of the tandem generator and yet the reduced voltage remains regulated and allows proper operation of the tandem generator. In conventional tandem generator, the central terminal 120 is charged by the charging system 130 where the voltage on the central terminal cannot easily be regulated below certain levels, such as below 5% of the nominal operating voltage.

Referring back to FIG. 1, at the terminal cell 120, the polarity of the ion beam can be changed by the stripping cell 134. Thus, for example, if the ion beam generated by the ion generator 122 is a negative ion beam 136, the polarity of the ion beam 136 is then changed to a positive ion beam. Thereafter, the ion beam 136 enters the second beam tube 108, where it is further accelerated. Thereafter, the ion beam 136 can be further conditioned (e.g., focused and/or steered) by, for example, the conditioning cell 146, and the energy of the ion beam 136 can be optionally determined and provided to the controller 126, which can control the high-voltage power supply 112 to adjust output voltage correspondingly. Accordingly, a precise and accurate ion beam is generated for a desired purpose such as, for example, low-energy NRA or other purposes.

According to the present invention, assuming that the ion beam 136 includes $H^-$ ions having an initial energy (e.g., the extraction voltage-prior to entering the first beam tube 104) of 50 keV, and if the terminal cell 120 is charged to 100 kV by the high-voltage power supply 112, after passing through the first beam tube 104, the ion beam 136 would have an energy of about 50 keV+100 keV. Then, assuming that a stripping gas (e.g., Nitrogen) is used to change the polarity of the ion beam 136 so that it now includes $H^+$ ions, the ion beam 136 can then be accelerated by the second beam tube 108 and would have an energy of 50 keV+100 keV+100 keV=250 KeV (i.e., an energy equal to an initial energy, the energy provided by the acceleration voltage within the terminal cell 120 while the beam 136 is in the first beam tube 106 and the energy provided by acceleration voltage within the terminal cell 120 while the beam exits the second beam tube 108) upon exiting the second beam tube 108. Thus, the final energy $E_f$ of the ion beam would be equal to the post-stripping charge state q of each ion, the extraction voltage (e.g., of the ion generator) $V_i$, and the acceleration voltage $V_t$ and as is shown Equation (1) below.

$$E_f = V_i + (q+1)V_t$$

As previously mentioned, by using a regulated power supply for the high-voltage controller 112, the voltage transmitted to the terminal can be precisely controlled and regulated, even at reduced voltage below 5% of the nominal operating voltage of the tandem generator, at the high-voltage power supply (e.g., a highly accurate and stable switching power supply) without having to measure and control a voltage at the terminal using a conventional feedback system.

Figure 3:
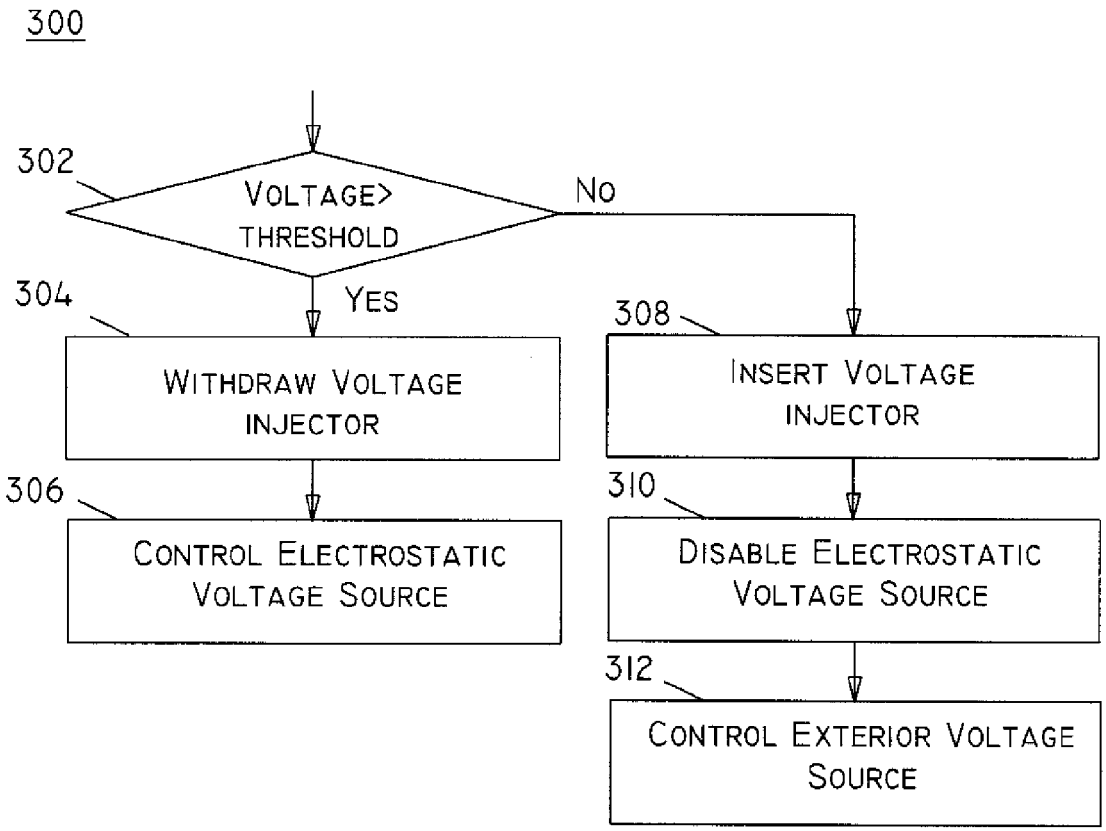
FIG. 3 is flow chart illustrating a process according to the present invention.

A flow chart illustrating a process according to the present invention is shown in FIG. 3. Process 300 begins at step 302 where it is determined (e.g., by the controller 126) whether the operating voltage (e.g., the desired voltage at the terminal cell 120) is greater than a predetermined threshold value. If it is determined that the operating voltage is greater than the threshold value, the process continues to step 304. However if it determined that the operating voltage is less than or equal to the threshold value, the process continues to step 308.

In step 304, the one or more high voltage leads (or voltage injectors) 140 are withdrawn from the cavity 128 via the load-lock valve 110 so that the high-voltage power supply 112 is not coupled to the terminal cell 120. This can prevent arcing when operating the tandem generator at voltages which greater than the threshold value. The process then continues to step 306 where, for example, the charging system 130 is operated and charges the terminal cell 120 to the operating voltage.

In step 308, the one or more high voltage leads 140 are positioned at least in part within the cavity 128 (e.g., via the load-lock valve 110) so that the high-voltage power supply 112 is coupled to the terminal cell 120. The process then continues to step 310 where the power supply 130 (e.g., the electrostatic voltage source) is optionally disabled (e.g., by not enabling power to the power supply 130. The process then continues to step 312 where the high-voltage power supply 112 is controlled so as to produce the operating voltage which is supplied to the terminal cell 120.

Thus, by using an external high-voltage power supply to supply operating voltages which are less than a threshold value, existing tandem accelerators using electrostatic induction systems can be modified to benefit from the features and advantages of the present invention.

A further advantage of the present invention is that by applying an external voltage source to the terminal inside the tandem accelerator, the use of costly and complex chain and/or belt charging systems can be avoided. Further, the voltage provided by the external high-voltage power supply can be graded using a conventional voltage-divider network, which for the sake of clarity is not shown. Accordingly, a proper voltage gradient would be present in the beam tube during operation.

The high-voltage power supply can include a highly accurate and stable source such as those which are used for electron or ion-beam lithography.

Thus, according to the present invention, a low-cost, stable, and easily regulated tandem accelerator that can be operated at low voltage levels is provided.

Certain additional advantages and features of this invention may be apparent to those skilled in the art upon studying the disclosure, or may be experienced by persons employing the novel system and method of the present invention, chief of which is that a more stable and easily regulated tandem accelerator which can operate at low voltage levels is provided. Another advantage of the present invention is that conventional tandem accelerators can be easily modified to incorporate the features and advantages of the present invention.

While the invention has been described with a limited number of embodiments, it will be appreciated that changes may be made without departing from the scope of the original claimed invention, and it is intended that all matter contained in the foregoing specification and drawings be taken as illustrative and not in an exclusive sense.

What is claimed is:

1. A method of producing an ion beam in a tandem accelerator, the method comprising the acts of:

insulating, in a cavity containing an insulating gas under pressure, a beam tube having first and second ends and a terminal situated between the first and second ends;

sealing, using a load lock valve, the insulating gas under pressure;

generating an operating voltage using a first voltage source situated outside the cavity when the operating voltage is to be less than or equal to a threshold value;

generating the operating voltage using a second voltage source situated inside the cavity when the operating voltage is to be greater than the threshold value;

coupling the terminal to the first or second voltage sources, the coupling including inserting a voltage injector through the load lock valve for coupling the terminal to the first voltage source when the operating voltage is to be less than or equal to the threshold value and decoupling and withdrawing the voltage injector from the load lock valve when the operating voltage is to be greater than the threshold value;

generating, using a particle source, an ion beam;

receiving the ion beam at the first end of the beam tube;

accelerating the ion beam in a first part of the beam tube that is situated between the first end of the beam tube and the terminal;

changing a polarity of the charge of the ion beam; and accelerating the ion beam in a second part of the beam tube which is situated between the terminal and the second end of the beam tube.

* * * * *